United States Patent [19]

Sauer

[11] 4,059,923

[45] Nov. 29, 1977

[54] SECURITY WINDOW GUARD

[76] Inventor: Abe Sauer, 1205 Bristol Apt. 17, Memphis, Tenn. 38117

[21] Appl. No.: 568,494

[22] Filed: Apr. 16, 1975

[51] Int. Cl.[2] ..... E06B 3/68; E06B 7/088

[52] U.S. Cl. ..... 49/57

[58] Field of Search ..... 49/56, 57, 61, 62, 63, 49/255

[56] References Cited

U.S. PATENT DOCUMENTS

| | | | |
|---|---|---|---|
| 250,592 | 12/1881 | Smith | 49/57 X |
| 999,682 | 8/1911 | Suits | 49/56 x |
| 1,438,202 | 12/1922 | Wieland | 49/57 |
| 2,016,044 | 10/1935 | McGuinness | 49/56 |
| 2,043,835 | 6/1936 | McGuinness | 49/56 X |
| 2,800,956 | 7/1957 | Xanten | 49/61 X |
| 3,099,865 | 8/1963 | Burnett | 49/57 X |
| 3,160,927 | 12/1964 | Busillo | 49/57 |
| 3,378,955 | 4/1968 | Wahlgren | 49/56 X |

FOREIGN PATENT DOCUMENTS

| | | | |
|---|---|---|---|
| 157,747 | 12/1904 | Germany | 49/57 |

*Primary Examiner*—Casmir A. Nunberg
*Assistant Examiner*—David H. Corbin
*Attorney, Agent, or Firm*—Beveridge, DeGrandi, Kline & Lunsford

[57] ABSTRACT

An improved security cover for windows includes a metal frame dimensioned to fit within the window frame outside the conventional window, and key-actuated locking means visible and operable only from the inwardly directed side is provided in the metal frame for cooperating with the adjacent window frame structure to firmly but releasably retain the rigid metal frame in position covering the window. Suitable security means such as bars, metal grill work, or expanded metal are provided in the metal frame opening, and storm windows, screens, or the like may also be mounted in and supported by the metal frame.

3 Claims, 8 Drawing Figures

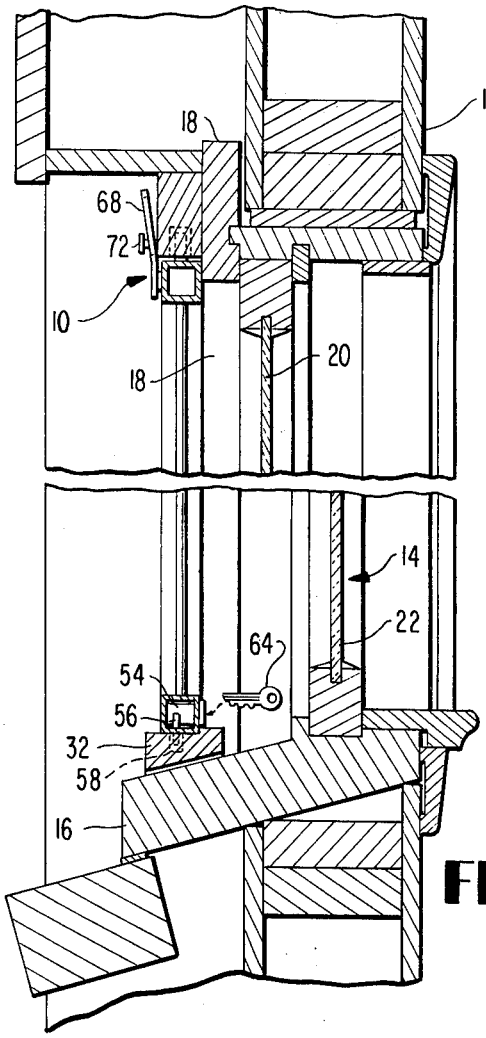
FIG. 2
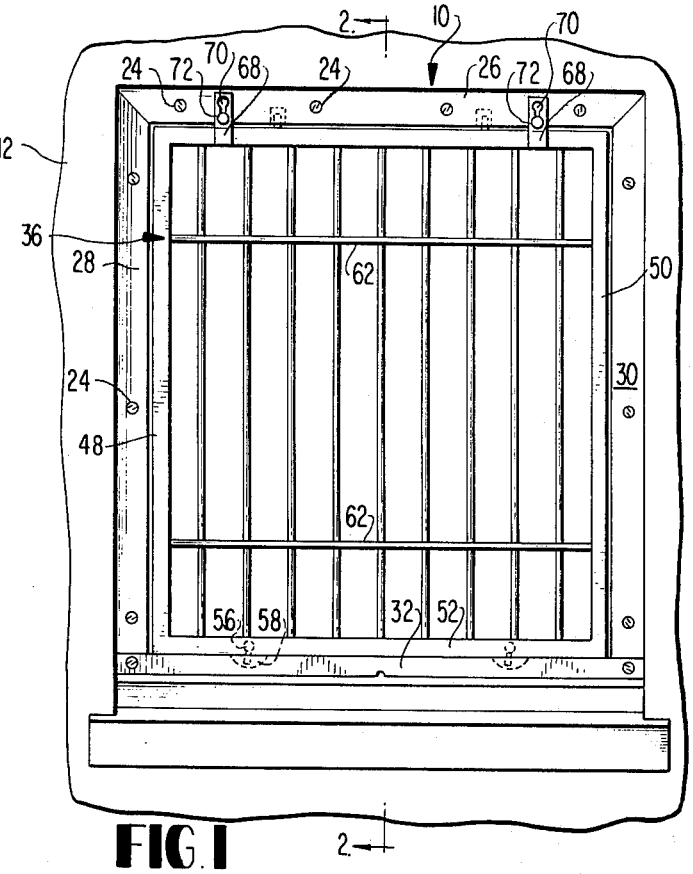
FIG. 1
FIG. 3a
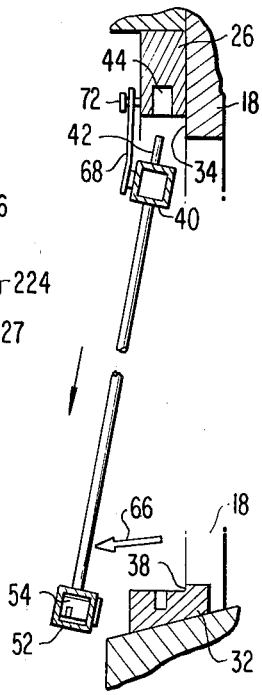
FIG. 3b
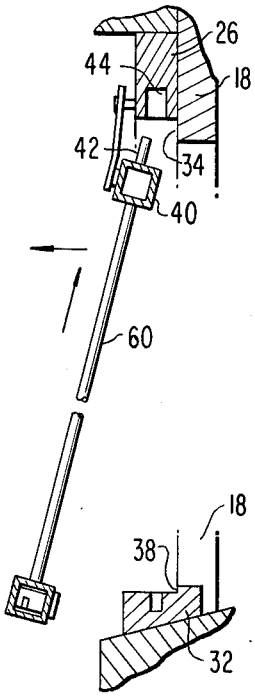
FIG. 4
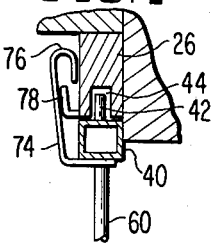
FIG. 7
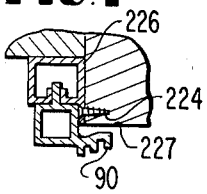
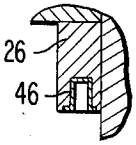
FIG. 5
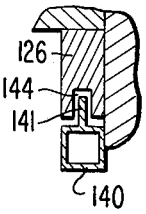
FIG. 6

SECURITY WINDOW GUARD

BACKGROUND OF THE INVENTION

1. Field of the Invention

This invention relates to security covers or guards for windows, and more particularly to an improved window guard that cannot be readily opened from the outside and therefore offers substantial protection against unauthorized entry through the window and yet which can readily be opened and/or removed from the interior of the building.

2. Description of the Prior Art

The rapid increase in burglaries, and particularly residential burglaries, in recent years has created an increased need and demand for an economical yet effective means for burglar-proofing conventional windows. It is, of course, well known to burglar-proof windows by providing a grill work of metal bars, expanded metal, or ornamental grill design which are rigidly mounted in position covering the window. However, these prior art devices suffer the serious drawback that they prevent passage equally as well from the inside as the outside, and therefore present a serious hazard in the case of fire. Further, these rigidly mounted prior art devices have presented serious obstructions to window washing, routine maintenance, painting, and the like.

It is also well known to provide window covers mounted on the exterior of the standard window and which are removable from the inside of the building. Examples of such prior art devices include the well known storm windows, screens and the like. However, these devices are generally not burglar proof and can even be readily removed from the exterior, frequently without destroying the screen or glass.

SUMMARY OF THE INVENTION

The foregoing and other deficiencies of the prior art devices are overcome by the present invention which provides a formidable barrier preventing entry through the window as by burglars, while at the same time being readily removable from the inside and with the proper key or tool. An important feature of the window guard according to the present invention resides in providing a rectangular frame of rigid metal construction which is adapted to fit tightly within an opening or frame around the window and in outwardly spaced relation to the conventional window. The top of the rigid metal frame is provided with a plurality of relatively heavy, short pin members, or alternatively by a continuous tongue member, adapted to be received in recesses in the window frame structure to prevent the top of the rectangular frame from being forced or pried away from the window frame. The bottom portion of the rectangular frame is also secured, in use, against forceful withdrawal by a plurality of key-actuated locks, each having a bolt adapted to project into a keeper slot in the frame structure surrounding the window. The key-actuated locks are visible only from the side of the rigid metal frame which faces inwardly toward the conventional window so that the frame gives the outward appearance of being permanently and rigidly mounted over the window. A suitable grill structure, such as a plurality of metal bars, or the like, is provided within the open rectangular metal frame, with the grill being designed to positively prevent a person from passing through the window with the window guard installed thereover.

In the event that it is desired to open the window guard, as to provide an escape in the event of fire, or to provide access to the window from the exterior as for cleaning, it is only necessary to unlock, with a suitable key maintained inside the building closure, the locks adjacent the bottom of the rigid metal frame, and then push the bottom of the frame outward and permit the structure to drop, thereby disengaging the pins from the slots at the top of the structure. To prevent the window guard from falling, suitable hanger means, such as a modified screen hanger, may be provided.

BRIEF DESCRIPTION OF THE DRAWINGS

Other objects and advantages of the invention according to the present invention will become more apparent from the detailed description contained hereinbelow, taken in conjunction with the drawings, in which:

FIG. 1 is a plan view of a window guard according to the invention and mounted in a window opening;

FIG. 2 is a fragmentary sectional view taken along line 2—2 of FIG. 1;

FIG. 3*a* is a fragmentary sectional view illustrating the window guard being moved to an open position;

FIG. 3*b* is a view similar to FIG. 3*a* and illustrating the manner of removing the window guard from the window opening;

FIG. 4 is a fragmentary sectional view illustrating the guard installed in the window and illustrating an alternate hanger structure therefor;

FIG. 5 is a fragmentary sectional view of a portion of the structure shown in FIG. 4 and illustrating a means of reinforcing the structure;

FIG. 6 is a view similar to FIG. 4 and illustrating an alternate embodiment of the invention; and FIG. 7 is a view similar to FIG. 6 and illustrating a further alternate embodiment.

DESCRIPTION OF THE PREFERRED EMBODIMENTS

Referring now to the drawings in detail, a window guard according to the present invention, indicated generally by the reference numeral 10, is illustrated in FIG. 1 as being mounted in a window opening of a building wall 12 adjacent to and on the outside of the conventional double hung or vertically sliding window assembly indicated generally by the reference numeral 14 in FIG. 2. The window assembly includes a windowsill 16 and exterior frame members 18 cooperating to define a generally rectangular opening closed by the conventional windows 20, 22.

Rigidly mounted on the sill 16 and frame members 18, as by tamper proof screws 24, is a second open rectangular frame defined by a top horizontal frame member 26, opposed vertical side members 28, 30, and a lower horizontal frame member 32. The inwardly directed surfaces of frame members 26, 28 and 30 are spaced outwardly from the inwardly directed surfaces of window frame members 18, as clearly illustrated in FIGS. 3*a* and 3*b*, whereby the outwardly directed surface of members 18 define a shoulder 34 for supporting a movable, rectangular window guard/frame assembly 36. Bottom frame member 32 is formed with a shoulder 38 which cooperates with the shoulder 32 to provide lateral support completely around the inner periphery of the frame 36 when installed in the position illustrated, for example, in FIGS. 1 and 2.

Rectangular frame 36 is constructed of relatively heavy metal members, preferably rectangular steel tubing rigidly joined as by welding at the four corners of the assembly. Frame 36 consists of an upper horizontal structural beam member 40 having rigidly mounted, as by welding, on its upper surface a plurality of locking or anchoring pins 42 adapted to fit within downwardly directed openings 44 in the lower edge surface of frame member 26 as shown in FIG. 4. Although the pins 42 are illustrated as fitting very loosly within the openings 44, in practice, this will be a relatively tight fit, and if desired, where the member 26 is made of wood, the openings 44 may have a metal thimble or liner 46 mounted therein for reinforcing the opening and to provide the desired close fit without the possibility of binding as the window guard is mounted in and removed from the window.

Rigid frame 36 also includes a pair of similar vertically extending side members 48, 50 and a bottom horizontal frame member 52. Mounted within the hollow bottom tubular member 52, and if necessary within the vertical members 48, 50, are a plurality of key-actuated locks 54 having bolt 56 adapted to project through the bottom or outwardly directed surface of their associated tubular frame member into keeper openings 58 within the frame member 32 and/or the frame members 28, 30. The locks 54 are visible only from the side of the frame 36 which faces the interior of the building so that, from the exterior, the assembly gives the overall impression of being rigidly and fixedly mounted in the frame. Further, rigidly mounted within the rectangular opening of the frame 36 is a security grill work illustrated in the drawings as a plurality of vertical bars 60 and reinforcing horizontal members 62. It is understood, of course, that this construction may be replaced with an ornamental grill work, or other design, the only requirement being that it be of sufficient strength and design to act as a barrier against entry through the window.

In use, the security guard is mounted over the window by first inserting the rigid metal pins 42 into the openings 44 in the frame member 26 and lifting the frame 36 while simultaneously pushing the bottom portion inwardly to seat the rigid metal frame against the shoulders 34, 38. The locks 54 are then actuated by inserting a key 64, as illustrated in FIG. 2, and projecting the bolts 56 into the keeper slots 58. A plurality of locks 54 are preferably employed at spaced intervals along the bottom portion of the window guard to rigidly retain the guard in position against substantial prying or pulling forces and to generally add strength and rigidity to the structure as installed.

When it is desired to open the window guard, as to more easily obtain acess to the window for cleaning, or in emergencies as in the case of a fire, the key 64 is inserted in the locks 54 to retract the bolts 56 into the hollow tubular frame members and the bottom of the window guard assembly is pushed outwardly as indicated by the arrow 66 in FIG. 3*a*. When the frame member 52 is pushed outwardly beyond the frame member 32, the window guard will drop, retracting the pins 42 from the openings 44 and the entire window guard can be removed.

When it is desired to assure against the window guard dropping completely, a simple hanger assembly may be employed which will support the weight of the guard while permitting it to swing outwardly at the bottom. Such a hanger assembly is illustrated in FIGS. 1–3 as including a strap member 68 having its bottom end mounted on the top frame member 40 as by a pin member 69. The member 68 has a key-slot 70 formed therein which fits over a headed pin member 72 on the frame member 26. An alternate hanger assembly is illustrated in FIG. 4 as including a strap member 74 mounted on the top frame member 40 and having a downwardly open hook portion 76 adapted to engage and cooperate with an upwardly directed staple member 78 on frame member 26.

Referring to FIG. 6, an alternate embodiment of the invention is illustrated wherein the top frame member 140 is illustrated as an extrusion member having an upwardly projecting flange 141 extending along its full length. In this embodiment, rather than a plurality of openings 44 as described above, a continuous slot 144 is formed in the top frame member 126 which corresponds with frame member 26 in the previously described embodiment.

FIG. 7 illustrates a further alternate embodiment wherein the rigid metal frame member is illustrated as having integrally formed thereon an inwardly projecting flange 90 designed to receive the conventional self-storing screen and storm windows. This embodiment also illustrates the use of metal frame members 226 which correspond to frame members 26, 28 and 30 of the previously described embodiment, with the metal frame member 226 being in the form of a rigid metal channel having a inwardly extending flange 227 for mounting the assembly as by screws 224.

While I have disclosed and described preferred embodiments of my invention, I wish it understood that I do not intend to be restricted solely thereto, but that I do intend to include all embodiments thereof which would be apparent to one skilled in the art and which come within the spirit and scope of my invention.

I claim:

1. In a security guard for windows having a rigid metal grid assembly mounted on the window frame and covering the window opening, the improvement wherein said security guard includes a fixed rectangular frame which extends entirely about the window frame to the exterior of the window opening, said fixed frame including generally opposed horizontal top and bottom frame members and opposed vertically extending side frame members, each of the opposed members of at least one of said opposed horizontal top and bottom frame members and said opposed vertically extending side frame members including orifice means in the inwardly directed surface thereof; a rigid open rectangular frame movably mounted in said fixed frame and including opposed top and bottom beams and opposed side beams, said rigid open rectangular frame being inset within said fixed frame with said beams thereof normally disposed in closely adjacent parallel relation to corresponding members of said fixed frame and with the exterior surface of said beams thereof non-extendant beyond the exterior surface of corresponding members of said fixed frame, each of the opposed beams of at least one of said opposed top and bottom beams and opposed side beams including keeper means, said orifice means of said fixed rectangular frame and said keeper means of said rigid open rectangular frame being provided on respectively corresponding members thereof and positioned so that said keeper means of said rigid rectangular frame cooperatively engages with said orifice means of the corresponding member of said fixed frame, said keeper means comprising key actuated blinded mortice lock means including bolt means adapted to project into said orifice means of the member of said fixed frame corresponding to the member of said rigid open rectangular frame having the same in a manner to lock said movable frame in said fixed frame, the key receiving face of said key actuated blinded mortice lock means being positioned on the inner side of said opposed beam having the same and opening toward the window opening about which said security guard is provided; and a metal grid rigidly mounted within the opening of said movable frame and covering the window thereof in an outwardly spaced relation thereto.

2. A security guard as defined in claim 1 wherein said keeper means are provided on said top and bottom beams, the keeper means of said top beam comprising a plurality of metal pins rigidly mounted on said top beam and projecting upwardly from the top surface thereof, and the keeper means of said bottom beam comprise a plurality of spaced apart key actuated blinded mortice lock means, each of said key actuated blinded mortice lock means including a bolt means extendable to project downwardly from the bottom surface of said beam having the same, each said pins and said bolt means of said key actuated blinded mortice lock means being respectively extendable from the top surface of said top beam and the bottom surface of said bottom beam intermediate the planes of the interior and exterior surfaces thereof, and said top and bottom frame members are provided with said orifice means in juxtaposition to respectively receive said pins of said top beam and said bolt means of said key actuated blinded mortice lock means of said bottom beam.

3. A security guard as defined in claim 2 including a hanger assembly for supporting said rigid open rectangular frame in a manner to permit said rigid open rectangular frame to be opened from said fixed frame by swinging said rigid open rectangular frame outwardly and then downwardly at the bottom and away from said bottom frame member of said fixed rectangular frame, said hanger assembly including support means mounted on said top frame member of said fixed frame and strap means mounted on said top beam of said rigid open rectangular frame, said strap means cooperatively interengaging said support means on displacement of said bottom beam of said rigid open rectangular frame from within said fixed frame to support said rigid open rectangular frame while permitting said pin means of said top beam to be withdrawn from said orifice means of said top frame member and whereby said strap means id detachable from said support means on further pivotal outward and upward movement of said rigid open rectangular frame with respect to said fixed rectangular frame.

* * * * *